US007896445B2

(12) United States Patent
Bechem

(10) Patent No.: US 7,896,445 B2
(45) Date of Patent: Mar. 1, 2011

(54) METHOD AND APPARATUS FOR THE MILLING CUTTING OF MATERIALS

(75) Inventor: Ulrich Bechem, Iserlohn-Summem (DE)

(73) Assignee: Bucyrus Europe GmbH, Lünen (DE)

( * ) Notice: Subject to any disclaimer, the term of this patent is extended or adjusted under 35 U.S.C. 154(b) by 164 days.

(21) Appl. No.: 12/438,140

(22) PCT Filed: Aug. 30, 2007

(86) PCT No.: PCT/EP2007/007600

§ 371 (c)(1),
(2), (4) Date: Feb. 20, 2009

(87) PCT Pub. No.: WO2008/025555

PCT Pub. Date: Mar. 6, 2008

(65) Prior Publication Data

US 2010/0001574 A1 Jan. 7, 2010

(30) Foreign Application Priority Data

Aug. 31, 2006 (DE) ..... 10 2006 040 881

(51) Int. Cl.
*E21C 27/22* (2006.01)

(52) U.S. Cl. ..... 299/85.1; 299/71; 299/75

(58) Field of Classification Search ..... 299/71–78, 299/85.1

See application file for complete search history.

(56) References Cited

U.S. PATENT DOCUMENTS

| | | | | |
|---|---|---|---|---|
| 3,069,147 | A * | 12/1962 | Poundstone et al. | 299/85.1 |
| 3,412,816 | A * | 11/1968 | Lautsch | 299/85.1 |
| 3,445,138 | A * | 5/1969 | Armin et al. | 299/85.1 |
| 3,477,762 | A * | 11/1969 | Pal et al. | 299/85.1 |
| 4,371,210 | A | 2/1983 | Leibee | |
| 5,192,116 | A | 3/1993 | Turner et al. | |
| 5,810,449 | A * | 9/1998 | Grathoff | 299/85.2 |
| 5,924,222 | A * | 7/1999 | Stoetzer | 299/79.1 |
| 6,626,500 | B1 * | 9/2003 | Cribb et al. | 299/78 |
| 7,631,942 | B2 * | 12/2009 | Bechem et al. | 299/85.1 |
| 2008/0116734 | A1 * | 5/2008 | Bechem et al. | 299/85.1 |

FOREIGN PATENT DOCUMENTS

| | | |
|---|---|---|
| DE | 288984 | 11/1915 |
| DE | 2723675 | 11/1978 |
| WO | PCT/EP2006/000683 | 1/2006 |

OTHER PUBLICATIONS

International Search Report for PCT/EP2007/007600.
English translation of the International Preliminary Report on Patentability and Written Opinion dated Mar. 17, 2009 of International Appln. No. PCT/EP2007/007600, filed Aug. 30, 2007.

* cited by examiner

*Primary Examiner* — Frederick L Lagman
(74) *Attorney, Agent, or Firm* — Rankin, Hill & Clark LLP

(57) ABSTRACT

An apparatus for the milling and/or drilling cutting of materials, in particular for the removal of rock, minerals or coal, with a tool drum which is mounted on a drum carrier rotatably about a drum axis, in which a plurality of tool shafts, which carry cutting tools at their ends projecting from the tool drum, are rotatable drivable mounted, at least two of the tool shafts being drivable by a common gear drive which has power take-off gearwheels arranged fixedly in terms of rotation on the tool shafts, and a common drive element which cooperates with the power take-off gearwheels. The drive element and the tool drum being rotatable in relation to one another and the shaft axes of the tool shafts standing transversely to the drum axis.

32 Claims, 10 Drawing Sheets

METHOD AND APPARATUS FOR THE MILLING CUTTING OF MATERIALS

This application claims priority to and the benefit of the filing date of International Application No. PCT/EP2007/007600, filed Aug. 30, 2007, which application claims priority to and the benefit of the filing date of German Application No. 10 2006 040881.0, filed Aug. 31, 2006, both of which are hereby incorporated by reference into the specification of this application.

The invention relates to an apparatus for the milling and/or drilling cutting of materials, in particular for the removal of rock, minerals or coal, with a tool drum which is mounted on a drum carrier rotatably about a drum axis, in which a plurality of tool shafts, which carry cutting tools at their ends projecting from the tool drum, are mounted so as to be capable of being driven in rotation, at least two of the tool shafts being drivable by a common gear drive which has power take-off gearwheels, arranged fixedly in terms of rotation on the tool shafts, and a common drive element which cooperates with the driving gearwheels, the drive element and the tool drum being rotatable in relation to one another. The invention also relates, furthermore, to a method for the milling or removal of materials, such as, in particular, rock, coal or the like, and to the use of such an apparatus and also to the use of the method.

BACKGROUND OF THE INVENTION

For the removal of hard materials, such as rock, ore and other extraction products in underground or overground mining, but also for the milling cutting of asphalt or concrete components in roadbuilding or building construction and the like, a multiplicity of milling systems are known which are provided with rotary-driven drums or disks, to which milling tools, such as, for example, straight shank chisels are attached in a uniform distribution. As regards disk shearer loaders used in underground mining, rock or coal is broken down by means of shearing disks which in the full cut the material to be extracted, so that about half of all the cutting tools arranged on the circumference of the drum are simultaneously in engagement with the working face. On account of the relatively long contact times between the cutting tools and the material to be broken down, the wear even of cutting tools provided with hard metal tips is high especially where hard materials to be broken down are concerned. Moreover, because of the multiplicity of individual cutting tools which are in engagement simultaneously with the material to be broken down, the pressure force remaining for each tool is relatively low, and therefore a relatively high advancing force has to be exerted on the apparatus in the direction of advance or working direction in order to break down hard materials.

In order to increase the extraction performance of apparatuses particularly for the removal of hard rock, the inventors developed apparatuses which operate by impact overlap in order to achieve a high releasing pulse for the removal of the minerals, hard rock or concrete. In the case of apparatuses operating by impact overlap, the mounting of the individual elements of the apparatus and also noise pollution sometimes present considerable problems.

Furthermore, the inventors developed the apparatus known from the previously published WO2006/079536 A1, on which the preamble of claim 1 is based and in which, even in the cutting of hard materials, long service lives of the tools can be achieved by means of reduced pressure forces. The operating principle of the apparatus known from WO2006/079536 A1 is based on arranging a plurality of tool spindles in a spindle drum or tool drum eccentrically around a drum axis in such a way that the spindle axes of the tool spindles lie parallel or, at most, at a slight inclination to the axis of rotation of the tool drum. All the tool spindles are mounted in the tool drum in such a way that the cutting tools are located, distributed on the circumference, in front of the end face of the tool drum. In operational use, a rotation of the tool drum is overlapped with a rotation of each tool spindle. What can be achieved by the overlapping of the rotational movements of the tool drum and of the tool spindles is that only relatively few cutting tools are simultaneously in operative engagement with the material to be milled or to be removed, thus resulting in a high releasing force for each individual cutting tool. In operational use, the known cutting apparatus is moved transversely with respect to the axis of rotation of the tool drum and therefore also transversely with respect to the axis of rotation of each individual tool shaft. By means of the known apparatus, excellent service lives of the tools, even in the case of hard materials and a high removal performance, are achieved. However, in the removal of the materials on closed surfaces, but also in the drilling open of core drillholes or the like, entry by virtue of a feed movement of the apparatus into the material to be removed sometimes presents problems and is sometimes impossible. Furthermore, the breakdown of materials on a large surface requires a considerable diameter of the tool drum, thus resulting in a comparatively high overall weight of the apparatus.

SUMMARY OF THE INVENTION

The object of the invention is to provide an apparatus which is capable of economically removing even rock or other materials having high strengths, with a high removal performance and with a large removal surface. The apparatus is to ensure high operating reliability, is to be capable of being used in the most diverse possible fields of use and is to avoid the disadvantages of the known apparatus which have been indicated.

To achieve these objects, an apparatus having the features of claim 1 is proposed. According to the invention, there is provision for the shaft axes of the tool shafts to stand transversely to the drum axis. In contrast to the apparatus known from WO2006/079536 A1, therefore, an arrangement of the tool shafts corotating with the tool drum is selected in which the shaft axes of the individual tool shafts no longer stand essentially parallel, but transversely, to the drum axis of the tool drum. On account of the significantly changed orientation of the shaft axes of the tool shafts, the cutting tools are in this case no longer on the end face of the tool drum, but, instead, milling or removal takes place radially outside the circumference of the tool drum. The varied orientation of the tool shafts gives rise to a fundamentally different overlapping of the rotational movement of the tool drum and of the rotation of the tool shaft. Nevertheless, even in the apparatus according to the invention, a very short, compact and pulse-like engagement of the individual cutting tools in the rock to be broken down can be achieved, and therefore the advantages of the known apparatus, in particular a very high releasing force, even with a reduced available pressure force of the tool drum, are preserved.

According to an advantageous refinement, the shaft axes of the tool shafts may stand perpendicularly to the drum axis. Alternatively to this, the shaft axes of the tool shafts may also stand angled to the drum axis, the angle of the angling amounting to at least 45° and preferably being greater than about 80°. Basically, it would also be possible that the shaft axes of one or some of the tool shafts stand perpendicularly to the drum axis and, at the same time, the shaft axes of other tool shafts stand identically or differently angled to the drum axis.

In the apparatus according to another aspect of the invention, in operational use, a working movement of the apparatus takes place parallel to the drum axis, and/or that a feed movement of the apparatus by the amount of the cutting depth for the next removal operation takes place perpendicularly to the drum axis. In the solution according to the invention, in this case, preferably all the cutting tools lie radially outside the tool drum, in particular radially outside the circumference of the tool drum, and, in operational use, the material is removed in a sickle-shaped manner outside the circumference of the tool drum. On account of the rotational movement of the drum and of the arrangement of the shaft axes of the tool shafts, in operational use the cutting tools rotate transversely to the drum axis, and the material is removed outside a circumference of the drum. Owing to the overlap of the rotational movements which deviates from the prior art and to the fact that the cutting tools lie further outward, while the tool drum size remains the same, even shorter tool engagement times can be achieved than in the system previously published. Contact between each individual cutting tool and the material to be removed may advantageously take place particularly when the instantaneous direction of movement of the cutting tool coincides with the direction of movement of the tool drum.

According to an advantageous refinement, the tool drum and at least some of the tool shafts may have a common rotary drive. In this refinement, as a result of a rotation of the tool drum, the tool shafts also acted upon by the common rotary drive can be set in rotation automatically. According to a design variant, the rotary drive could have a drive shaft, which is connected fixedly in terms of rotation to the tool drum, is mounted in the drum carrier and can be driven by means of a drive device, and one or at least one driving gearwheel as a drive element, which is fastened fixedly in terms of rotation to the drum carrier and which meshes with the power take-off gearwheels on the respective tool shafts. A corresponding apparatus can have a particularly compact set-up, while very high forces and torques are transmitted and, at the same time, there is a fixed ratio of the rotational speeds between the tool drum or the drive shaft and the driven tool shafts. In order to transmit the drive forces reliably, the driving gearwheel and the associated power take-off gearwheels may form an angular gear which consists of toothed bevel wheels and is constructed in the manner of an epicyclic gear and in which the driving gearwheel or driving gearwheels in each case form the sun wheel and the power take-off gearwheels comoved with the tool drum form the planet wheels. In an alternative refinement, the driving gearwheel may consist of a toothed contrate wheel with which cylindrical gearwheels mesh as associated power take-off gearwheels. When the contrate gear with planet wheels is used, in operational use the forces exerted on the respective mountings are reduced considerably, since no axial forces are transmitted via the contrate gear.

In order to achieve a favorable release behavior in the case of a common rotary drive for the tool drum and for the tool shafts, the gear preferably has a step-up ratio of between about 3:1 and 9:1, in particular of about 6:1 and 8:1, between the drive shaft and the tool shafts. Where particularly hard cutting tools, such as, for example, diamond tools or ceramics, are concerned, the step-up ratio may even amount, for example, to 12:1 and higher. So that high pressure forces can easily be absorbed, according to an advantageous refinement the tool drum may be supported on both sides of the tool shafts on a drum carrier, a journal or a bearing for holding the tool drum on two sides being formed preferably on that side of the tool drum which lies opposite the drive device. In the case of smaller tool drums or softer materials to be broken down, however, it can be sufficient even to hold the tool drum on one side.

In an alternative refinement, the tool drum may have a drum drive which is decoupled from a gear drive for the drive element. In this refinement, in which work is then carried out correspondingly by means of two separate rotary drives, the rotational speed ratio between the rotational speed of the tool drum, at which the tool shafts corotate transversely with respect to their shaft axes, and the rotational speed of the respective tool shafts may be set virtually as desired. For setting, it is particularly advantageous if the drum drive and/or the gear drive consist/consists of variable drives. For many applications, the drum drive and the gear drive may be arranged or may be coupleable on the same side of the tool drum. For this purpose, the tool drum may be provided, in particular, with an axially projecting shaft receptacle in which a gear drive shaft connected fixedly in terms of rotation to the driving gearwheel and projecting on both sides out of a reception bore of the shaft receptacle is supported or mounted rotatably. The gear drive shaft can then be supported, in particular, by means of a bearing in the reception bore and by means of a second bearing in a bearing cover screwed to the tool drum. A corresponding refinement is advantageous particularly when the shaft axes stand angled to the drum axis, and the driving gearwheel and the power take-off gearwheels are designed as bevel wheels of an angular gear having planet wheels. However, the shaft axes could also stand perpendicularly to one another. The shaft receptacle can then expediently be coupled to the drum drive and the gear drive shaft can be coupled to the gear drive.

In an alternative refinement with two separate rotary drives for the drum drive and for the gear drive, the drum drive may be arranged or coupleable on one side of the tool drum and the gear drive may be arranged or coupleable, offset axially, on the opposite side of the tool drum. According to an advantageous refinement, the tool drum may be provided on the opposite side with an axially projecting annular extension with a shaft receptacle, in which a gear drive shaft connected fixedly in terms of rotation to the driving gearwheel and projecting on both sides out of a reception bore of the shaft receptacle is supported rotatably, the tool drum having on the other side a bearing extension on which the drum drive can be arranged or can be coupled. The gear drive shaft may expediently be mounted rotatably by means of a first bearing in the shaft receptacle of the annular extension and by means of a second bearing in the bearing extension, while the bearing extension may preferably consist of a bearing flange screwed to the tool drum. The bearing extension may be provided, in particular, with a toothing or a gearwheel, in order to drive-connect the drum drive and tool drum to one another in a simple way via gearwheels or toothed belts.

According to a further advantageous alternative refinement, the tool drum may be connected fixedly in terms of rotation to the power take-off side of a first hub gear and the driving gearwheel may be connected fixedly in terms of rotation to the power take-off side of a second hub gear, the two hub gears being arranged in a central receptacle. A refinement of this type has a particularly compact build and can therefore easily be moved along a large working face by means of pivoting arms or the like. The hub gears may, in particular, be designed as push-in gears with gear stages preferably arranged, encapsulated, in gear cases, the fastening flanges of the two hub gears being fastenable or fastened to the drum carrier. The drive of the hub gears could also take place, in particular, via toothed belts.

In all the refinements with separate rotary drives, the driving gearwheel and the power take-off gearwheels may once again be designed particularly advantageously as bevel wheels of an angular gear with planet wheels or, alternatively, a contrate wheel could form the driving gearwheel, while the power take-off gearwheels are designed as cylindrical gearwheels meshing with this. So that the apparatus has a particularly compact build, the power take-off gearwheels of all the tool shafts may be in toothed engagement with a single common driving gearwheel. Particularly in this refinement, the tool shafts may then also be arranged, distributed uniformly over the circumference, in the tool drum. Alternatively, however, the tool shafts could also be arranged, distributed non-uniformly and/or in groups, in the tool drum, and/or a separate driving gearwheel could be provided for each group.

It is advantageous, further, if each cutting tool arranged on a tool shaft is arranged, in relation to the arrangement of a cutting tool of a tool shaft lying in front of or behind it in the drum circumferential direction, so as to be offset by an angular amount and/or at a distance from the drive shaft or drum axis. The cutting tools are in this case preferably formed on or fastened to tool carriers which are connected releasably to the tool shafts. Alternatively, however, they could also be anchored directly to the ends of the tool shafts. In order to make it easier to exchange the tool shafts, these may be received in bearing bushes rotatably by means of bearings, and so as to be sealed off by means of shaft seals, and what is achieved in a relatively simple way by this is that the tool shafts can be inserted and locked exchangeably in a cartridge-like manner by means of the bearing bushes in drum chambers provided on the tool drum.

Depending on the material to be broken down and on the intended use of the apparatus according to the invention, various types of tools may be employed. In the removal of materials, such as rock, coal or minerals, in underground or overground mining, the cutting tools of the tool shafts can be a roller chisels or straight shank chisels which, for the undercutting removal of the material in a plurality of layers, are arranged on outwardly tapering tool carriers or ends of the tool shafts. The tool carriers or ends of the tool shafts may taper conically, arcuately or in a stepped manner. It is advantageous if the cutting tools on each tool shaft are arranged in cutting rows on pitch circles with different diameters, the distance between two cutting rows preferably being selected in such a way that all the cutting rows remove sickle-shaped cutting surfaces of approximately identical size. In this refinement, what can be achieved is that the service life of each individual cutting tool on the tool head of a tool shaft is approximately identical, so that an exchange of the cutting tools can take place at fixed maintenance intervals. Instead of undercutting tools, milling rollers may also be used. An apparatus operating with milling rollers as cutting tools may be used, in particular, in roadbuilding for the removal of coverings, in building construction for the renovation of floors and walls or in civil engineering for the drawing off, for example, of trenches and may be mounted, for example, on the boom of an excavator or the like. The milling rollers may be designed cylindrically or taper conically toward the cut material.

A plurality of cutting tools are preferably formed on each tool shaft. It is advantageous if the cutting tools of tool shafts succeeding one another in the circumferential direction of the tool drum are arranged so as to be phase-offset with respect to one another, so that a cutting tool of a following tool shaft strikes into the material to be cut or to be removed at a point different from that of the cutting tool of the preceding tool shaft. In most embodiments, it is sufficient to mount the tool shafts within the tool drum. In the case of particularly hard material, however, it may be advantageous if the tool shafts are supported rotatably at their radially outer end by means of a yoke with a journal which, in turn, is fastened to the tool drum, so that an additional mounting or support of the tool shafts takes place in each case at or near those ends of the tool shafts which carry the cutting tools.

For using the apparatus according to the invention in underground mining for the extraction of coal, it may be particularly advantageous if the tool drum is provided between adjacent tool shafts with radially extending scrapers or shovels, by means of which the material preferably released at the working face by means of undercutting cutting tools is loaded into a conveyor or the like of the extraction device.

The apparatus according to the invention is suitable particularly for use in a method for the milling or removal of rock, in which the rotational speed of the tool shafts, the rotational speed of the tool drum, the advancing speed of the apparatus parallel to the drum axis and/or the angular position of the cutting tools, arranged on the individual tool shafts, in relation to the angular position of the cutting tools of the tool shafts lying in front of or behind them in the circumferential direction are set such that a cutting tool of a following tool shaft does not strike at the rock or the like at the same striking point as a cutting tool of a preceding tool shaft. By the parameters being varied, namely the rotational speed of the tool drum forming a planet carrier, the rotational speed of the drive shaft, as a planet wheel shaft, carrying the driving gearwheel, the advancing speed of the apparatus and the cutting line spacing of the cutting tools, the path curve of the individual tool cutters of the cutting tools can be determined, and, consequently, the grain size and surface structure of the cut or removed material can be influenced reliably.

It is also advantageous if the rotary drive takes place by means of variable drives, so that different rotational speeds can be set continuously, even without an interruption in the cutting work. A corresponding design of the apparatus makes it possible that the respective drive-specific requirements can be adapted to the geometry of the surface to be cut and to the properties of the material to be cut or to be removed.

These and other objects, aspects, features and advantages of the invention will become apparent to those skilled in the art upon a reading of the Detailed Description of embodiments set forth below taken together with the drawings which will be described in the next section.

BRIEF DESCRIPTION OF THE DRAWINGS

The invention may take physical form in certain parts and arrangement of parts, a preferred embodiment of which will be described in detail and illustrated in the accompanying drawings which form a part hereof and wherein.

DETAILED DESCRIPTION OF EMBODIMENTS

Figure 1:
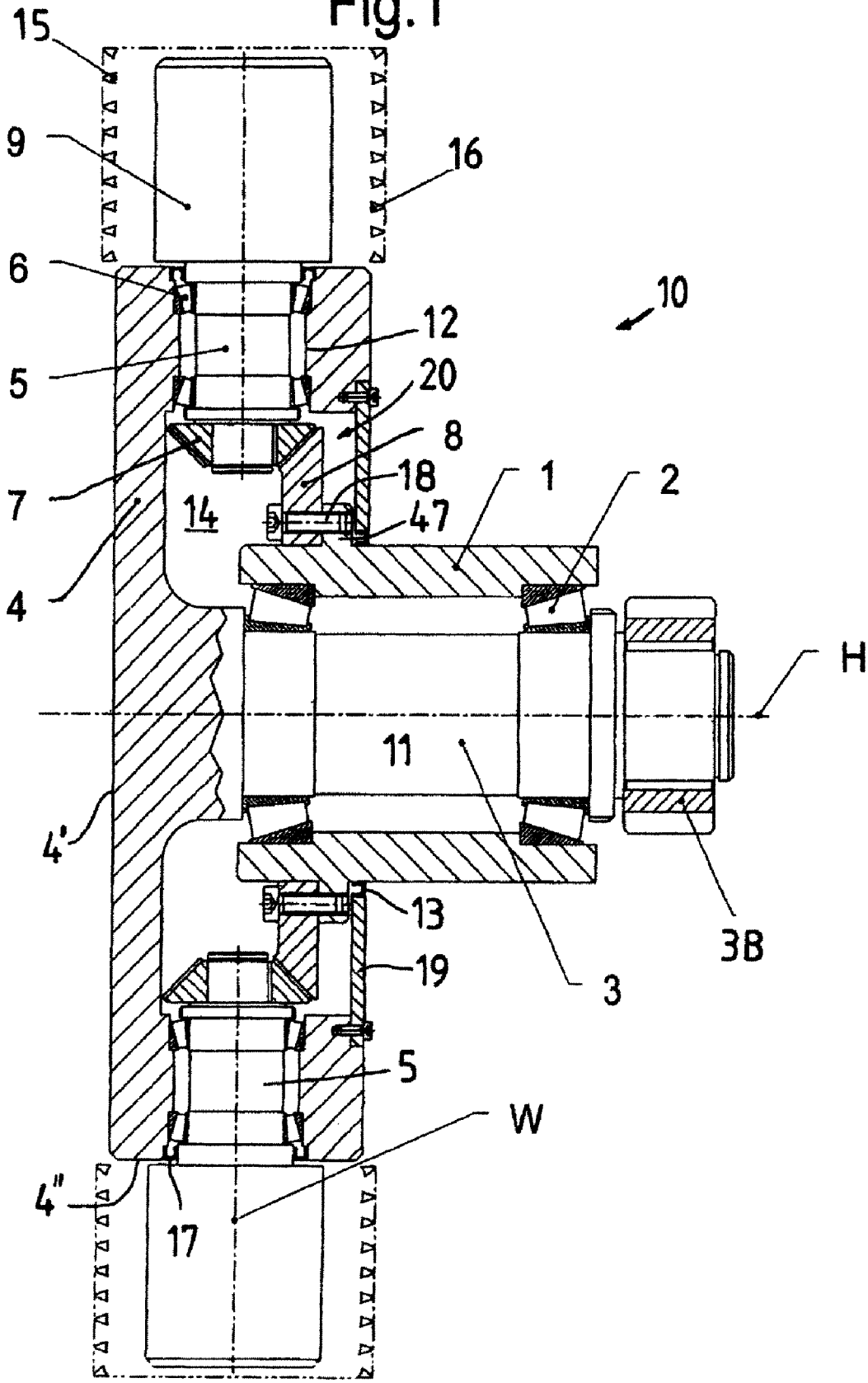
FIG. 1 shows in section an apparatus according to the invention in a first embodiment.

Referring now to the drawings wherein the showings are for the purpose of illustrating preferred and alternative embodiments of the invention only and not for the purpose of limiting same, Reference symbol 10 in FIG. 1 illustrates, as a whole, an apparatus according to the invention, for example for removal of coverings in roadbuilding, for the renovation of floors or walls in building construction or for use in mining, according to a first variant. The apparatus 10 comprises a drum carrier 1 which may be fastened to a suitable holding device or movement device for the apparatus 10, for example to the boom of an excavator, to the machine boom of an advance working machine or the like. The tubular, here hollow drum carrier 1 has a central bearing receptacle 11 which is designed centrically to the drum axis or main axis H and in which a drive shaft 3 connected fixedly in terms of rotation to a tool drum 4 is mounted freely rotatably by means of two tapered roller bearings 2 arranged in an O arrangement. One end of the drive shaft 3 is connected fixedly in terms of rotation to the tool drum 4, and the other end, projecting out of the drum carrier 1, of the drive shaft 3 serves for the rotationally fixed reception of a gearwheel 3*b*, to which a suitable rotary drive for the apparatus 10 can be coupled. The motive rotary drive may be formed by a motor with the following gear and, if appropriate, an overload clutch or the like. The drive shaft 3 and the tool drum 4 are connected fixedly in terms of rotation to one another or consist in one piece. The end face 4' of the tool drum 4 is completely closed, and the tool drum 4 has, distributed over its circumference, a plurality of radial bores or radial passages 12, in which tool shafts 5 are mounted in such a way that the shaft axes W of the tool shafts 5 stand transversely to the drum axis H, with the result that the free ends 9 of the tool shafts 5 are located completely radially outside the drum circumferential margin 4" of the tool drum 4. Depending on the size and diameter of the tool drum 4, about three to twelve tool shafts 5 may be arranged, distributed on the circumference of the tool drum 4. Here, again, the mounting of the tool shaft 5 in the radial passage 12 takes place by means of two tapered roller bearings 6 in an O-arrangement, the mounting of each bevel wheel shaft 5 taking place via the gear receptacle 14, open on one side, of the tool drum 4. A tool carrier 15 consisting of a milling roller in FIG. 1 and having individual cutting tools 16 located on it is fastened to the free end 9 of each tool shaft 5, a plurality of cutting tools, illustrated here only by their chisel tips, being arranged on each tool carrier 15, and the arrangement of the cutting tools 16 being such that they are distributed spirally over the carrier circumference of the tool carrier 15, so that, as far as possible, only one chisel tip of a cutting tool 16 lies on a radial line of each tool carrier 15. In the case of a cutting tool 15 designed as a milling roller, in each case a uniform angular offset and axial offset may be present between all the cutting tools 16.

In the cutting apparatus 10, only the gearwheel 3B on the drive shaft 3 is in engagement with an external drive. During a rotation of the drive shaft 3, the tool drum 4 connected fixedly in terms of rotation to this rotates, with the result that the tool shafts 5 arranged in the radial passages 12 likewise rotate about the drum axis H. By means of an angular gear, designated as a whole by reference symbol 20, a rotation of the individual tool shafts 5 is then derived from the rotational movement of the tool drum 4 and overlaps this. The angular gear 20 is arranged, protected against soiling, in the gear receptacle 14 of the tool drum 4. The annular gear 20, designed as an epicyclic gear, has a driving gearwheel 8 which is fastened fixedly in terms of rotation to a circumferential flange 47 of the drum carrier 1 and is consequently stationary in operational use and with which in each case meshes a power take-off gearwheel 7 which is connected fixedly in terms of rotation to the shaft end of the tool shafts 5 which project into the gear receptacle 14. The driving gearwheel 8, designed as a bevel gearwheel, is preferably screwed to the circumferential flange 47 by means of the connecting screw 18. Since the drum carrier 1 is connected to a machine boom or the like, the driving gearwheel 8 is stationary in relation to the tool drum 4, and, when the tool drum 4 rotates, the power take-off gearwheels 7 rotate as planet wheels around the driving gearwheel 8. The tool drum 4 in this respect forms the planet carrier. The step-up ratio between the driving gearwheel 8 and the power take-off gearwheels 7 may amount to 3:1 to 12:1 and above, depending on the size and configuration of the apparatus 10, a step-up ratio of about 6:1 to 8:1 affording particularly great advantages.

In the apparatus 10, the shaft axes W and the drum axis H stand perpendicularly to one another and the angular gear 20 is designed correspondingly. As a result of the rotation of the individual tool carriers 15 with the cutting tools 16, arranged so as to be offset spirally, and as a result of the additional rotation of the tool drum 4, during the cutting of material outside the circumference 4" of the tool drum 4 in each case only an extremely short contact time of the individual cutting tool 16 or chisel tips with the material to be removed or to be released, such as, for example, rock, is achieved. On account of this short contact time, the wear of the individual cutting tool 16 is very low. Depending on the gear and on the drive used, for example, the tool drum 4 may rotate at 60 rev/min, and the rotational speed of each tool shaft 5 amounts, for example, to 400 rev/min. In order to protect the angular gear 20 and the tapered roller bearings 2, 6 used, in each case shaft sealing rings 17 are arranged at the radial exit of the radial passages 12 to the circumference 4" of the tool drum 4, and the gear reception space 14 is closed by means of an annular disk 19 having a shaft sealing ring 13 at the inner orifice of the annular disk 19.

Figure 2:
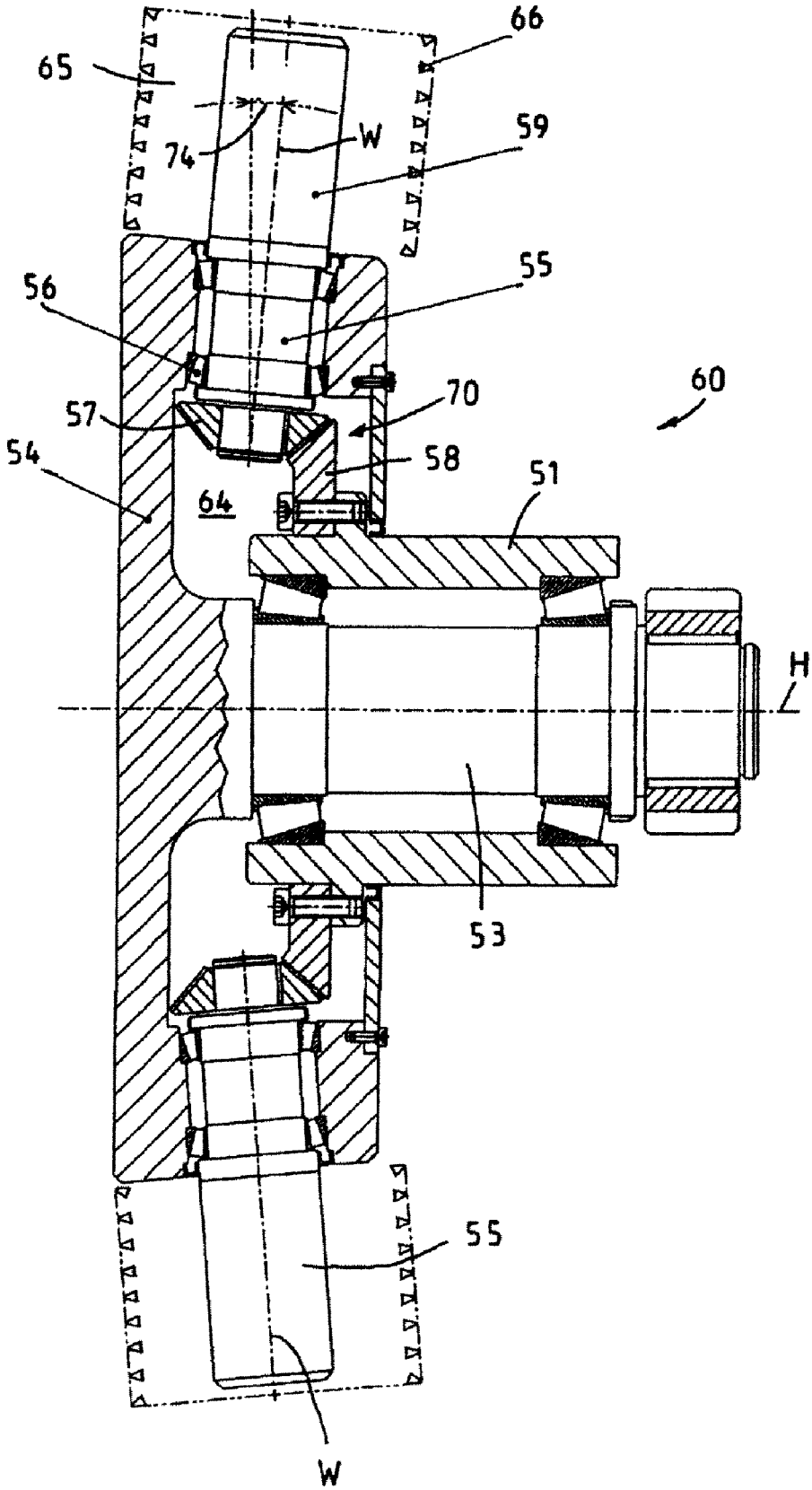
FIG. 2 shows a sectional view of a second embodiment with tool shafts, the shaft axes of which are inclined.

FIG. 2 shows a second exemplary embodiment of an apparatus 60 according to the invention, components structurally or functionally identical to those in the exemplary embodiment according to FIG. 1 being given reference symbols increased by 50. As in the previous exemplary embodiment, a drive shaft 53 is mounted rotatably within a drum carrier 51 and is connected fixedly in terms of rotation to a tool drum 54. The tool drum 54 is provided, distributed over a circumference, with a plurality of radial passages 62 for the reception of a corresponding number of tool shafts 55, the mounting of the tool shafts 55 in the radial passages 62 taking place once again by means of a pair of tapered roller bearings 56. As in the previous exemplary embodiment, tool carriers 65 with a plurality of preferably spirally distributed cutting tools 66 are arranged on the free shaft ends 59 of each tool shaft 55. In contrast to the previous exemplary embodiment, however, the shaft axes of the tool shafts do not stand perpendicularly to the drum axis H of the tool drum 54, but, instead, the shaft axes W of the tool shafts 55 run, inclined at the angle 74. The individual cutting tools 66 on the circumference of the tool carrier 65 consequently do not rotate perpendicularly to the holder axis H, but about an axis of rotation which here stands at an angle of about 85° obliquely to the drum axis H. The tool carrier 66 is again designed as a milling roller, as in the previous exemplary embodiment. In the apparatus 60, too, the rotation of the tool shafts 55 is derived from the rotation of the drive shaft 53 by means of an angular gear 70 which, as in the previous exemplary embodiment, is arranged in the gear reception space 64 of the tool drum 54 and comprises a driving gearwheel 58 connected fixedly in terms of rotation to the tool carrier 51 and power take-off gearwheels 57 which in each case mesh with said driving gearwheel and rotate as planet wheels and which are connected fixedly in terms of rotation to the individual tool shafts 55. On account of the angling between the shaft axes W, H of the tool shafts and of the tool drum 54, the angular gear 70 has a correspondingly inclined toothing on the bevel wheels 58, 57. As a result of the angling 74, an abrasion of the outer tool rows of the cutting tool 66 on the tool carriers 65 is avoided or reduced, and all the tool shafts 55, distributed over the circumference, may be angled with the same angling 74. However, individual tool shafts may also be designed with different anglings in groups, in which case, particularly when different rotational speeds of the tool shafts are also to be achieved, two or more driving gearwheels could also be arranged in the gear reception space.

Figure 3:
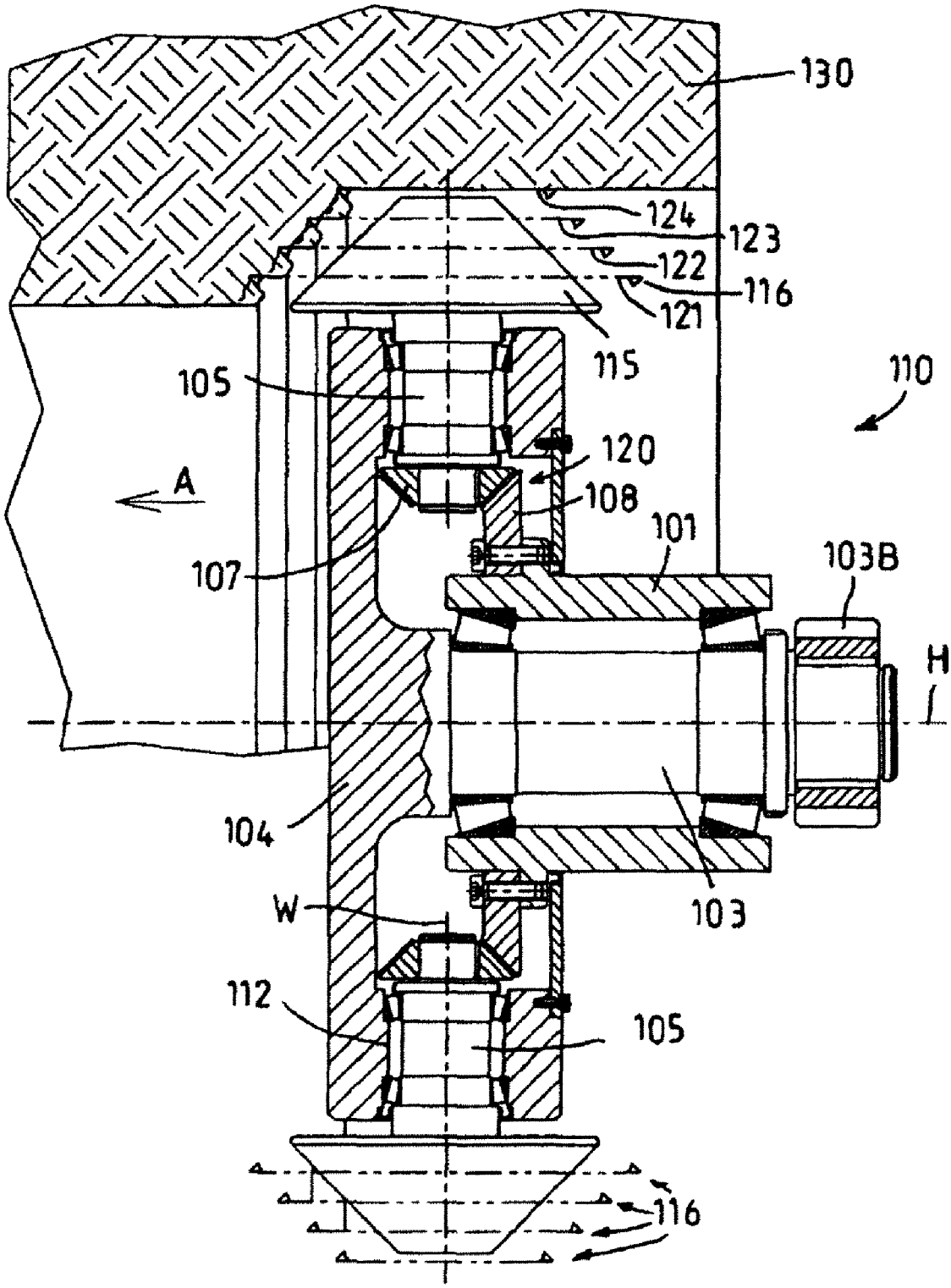
FIG. 3 shows a sectional view of an apparatus according to the invention in a third embodiment with undercutting tools for the removal of mineral rock.

FIG. 3 shows an apparatus 110 for a main field of use of an apparatus according to the invention, to be precise the undercutting removal of rock, coal or other minerals in underground or overground mining. Components functionally identical to those in the first exemplary embodiment are given reference symbols increased by 100. A drive shaft 103 is mounted in a drum carrier 101 connected to a machine boom or the like and is connected fixedly in terms of rotation to a tool drum 104 which has, distributed on the circumference, a plurality of radial passages 112 in which in each case tool shafts 105 are arranged in such a way that the shaft axis W of each tool shaft 105 here stands perpendicularly to the axis of rotation or drum axis H of the tool drum 104. The entire apparatus 110 once again has only one rotary drive which can be coupled to the gearwheel 103B fastened to the drive shaft 103, and the rotation of the individual tool shaft 105 is caused by means of an angular gear 120 which has a central common driving gearwheel 108, arranged concentrically to the drum axis H and locked on the drum carrier 101, for all the power take-off gearwheels 107 rotating as planet wheels and fastened to the free ends of the tool shafts 105. In contrast to the two previous exemplary embodiments, however, the cutting tools consist of cutting tools 116 operating in an undercutting manner, with here tool carriers 115 tapering conically outward or at an increasing distance from the drum axis H. In the exemplary embodiment shown, the tool carrier 115 has four tool lines 121, 122, 123, 124, there being arranged on each tool line 121-124 one or more cutting tools 116 which once again are indicated merely by their chisel tips and which here split in a stepped and undercutting manner the material 130 to be removed. The cutting tools 116 on the various tool lines 121-124, by virtue of their conical placement on the tool carrier 115, break up the material to be removed uniformly, the individual tool lines 121-124 preferably being arranged in such a way that cutting tools 116 on different tool lines 121-124 in each case remove a volume of identical size. By virtue of the conical arrangement of the cutting tools 116 on the conical tool carrier 115, each tool on the cutting lines lying radially further outward has a sufficient free space for the undercutting release of material. In FIG. 3, the working direction of the apparatus 110 according to the invention is illustrated by the arrow A, and it can be seen clearly that the working direction A of the apparatus 110 according to the invention lies parallel to the drum axis H. The feed movement of the apparatus 110 into the material 130 to be removed takes place correspondingly perpendicularly to the working direction A, consequently perpendicularly to the drum axis H. It can be seen clearly from FIG. 3, furthermore, that the individual cutting tools 116 rotate transversely or, here, perpendicularly to the drum axis H.

Figure 4:
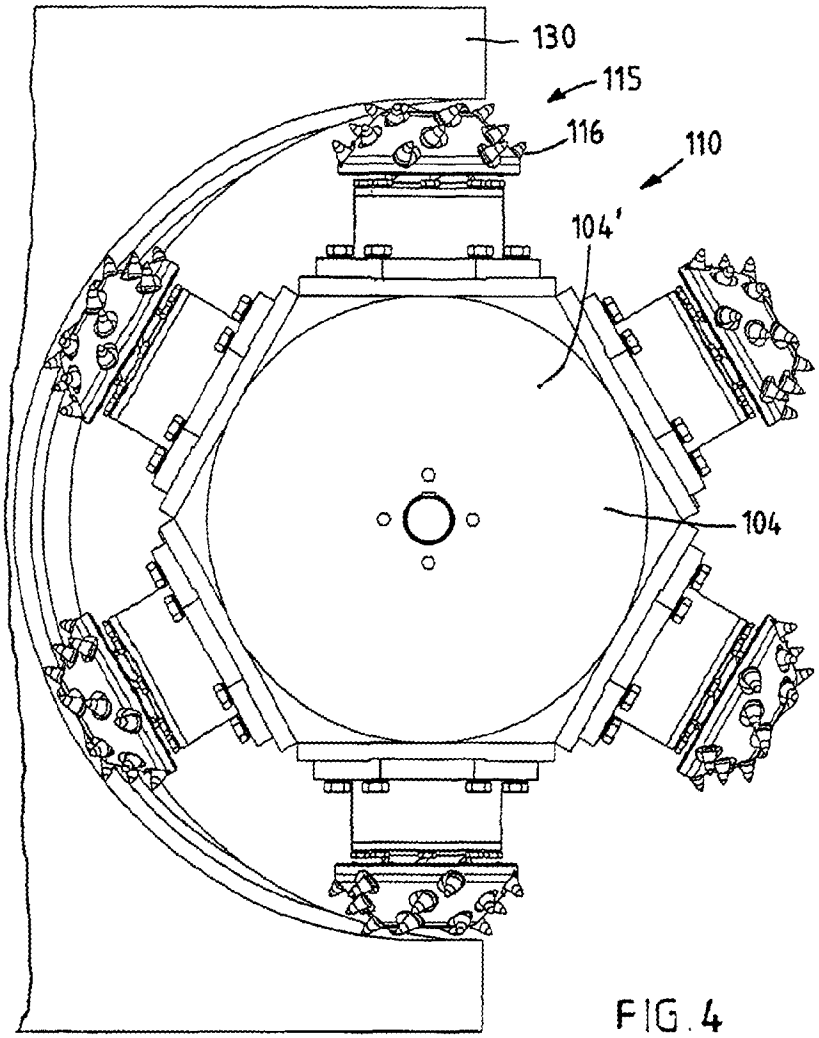
FIG. 4 shows the apparatus from FIG. 3 in a top view of the end face of the tool drum.

The set-up and working operation of the apparatus 160 according to the invention, shown in FIG. 3, are also evident from FIG. 4 which shows a view of the end face 104' of the tool drum 104. Here, overall, six tool shafts with associated conical or rounded tool carriers 115 at their ends are arranged, distributed over the circumference of the tool drum 104, each tool carrier 115 being provided with straight shank chisels, as cutting tools 116, arranged so as to be distributed on three tool lines. On account of the overlapped rotation of the tool drum 104 and of the tool carriers 115 corotating with the tool shafts, each individual cutting tool 116 executes a short cut in the material 130 to be removed, the cutting surfaces for the various tool rows running in a sickle-shaped manner. The cutting tools of the same cutting rows on different tool carriers are in this case arranged in such a way that a cutting tool 116 of a following tool carrier 115 carries out the removal of the material or the knocking out of the material at a point different from that of the cutting tool 116 of the preceding tool shaft. By means of the short tool engagement times, a tremendous cutting power can be achieved, with a low attack force for the apparatus 110 and at the same time with low wear of the individual cutting tools 116. The working direction of the apparatus 110 points, parallel to the drum axis, into the drawing plane.

Figure 5:
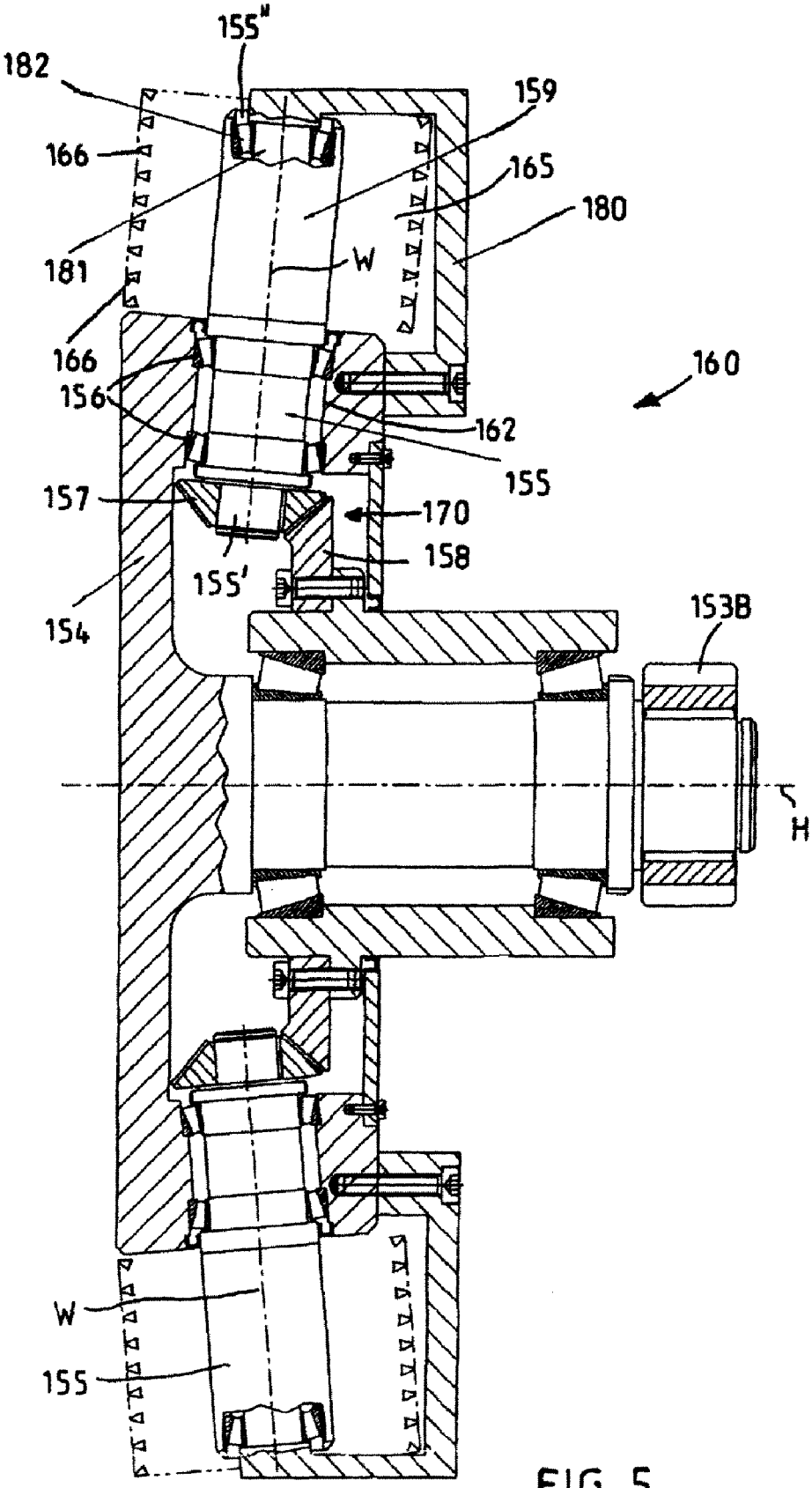
FIG. 5 shows a sectional view of a fourth exemplary embodiment of an apparatus according to the invention with tool shafts standing at an inclination and supported at the ends.

FIG. 5 shows a fourth exemplary embodiment of an apparatus 160 according to the invention. The tool drum 154 and the annular gear 170 interposed between the individual tool shafts 155 and the common driving wheel 157 have, in principle, an identical set-up to that in the exemplary embodiment according to FIG. 2, and reference is made to the statements given there. The apparatus 160 has a particular configuration for tool shafts 155, the shaft axes W of which stand at an inclination to the drum axis H of the tool drum 154. As in the previous exemplary embodiments, the tool shafts 155 are mounted, between their shaft ends 159, to which the tool carriers 165 are fastened preferably releasably, and the radially inner shaft ends 155', to which the power take-off gearwheels 157 are fastened, in the radial, here obliquely standing radial passages 162 by means of a mounting formed by two bevel wheel bearings 156. In contrast to the previous exemplary embodiments, however, all the tool shafts 155 arranged, distributed over the circumference, are supported rotatably on their free end faces 155" by means of a yoke 180. The yoke 180 extends approximately in a U-shaped manner over the drum side on which the driving gearwheel 153B for coupling to the rotary drive is arranged, so that the angled cutting tools 166 can cut into the material to be removed, freely and unimpeded by the yokes 180, outside the circumference of the tool drum 154, in each case at those ends of said cutting tools which project furthest. The yokes 180 are led around the tool carriers 165 on the outside and are provided with a journal 181 which runs parallel to the shaft axis W of the tool shafts 155 which, with further tapered roller bearings 182 being interposed, penetrates into the tool carrier 165 or the shaft end. A corresponding configuration is particularly advantageous when the cutting tools 166 consist of long milling rollers or the like.

Figure 6B:
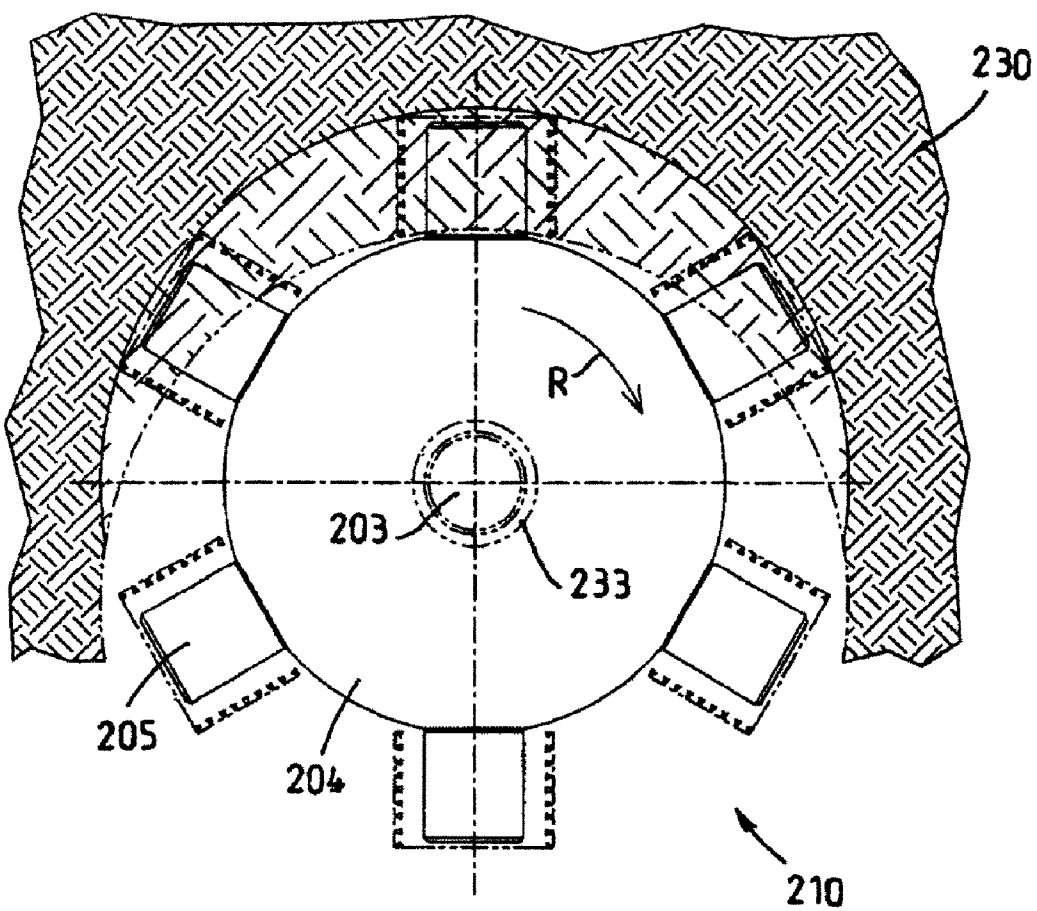
FIGS. 6A, 6B show, in section and in a top view, an apparatus according to the invention in a fifth exemplary embodiment.
Figure 6A:
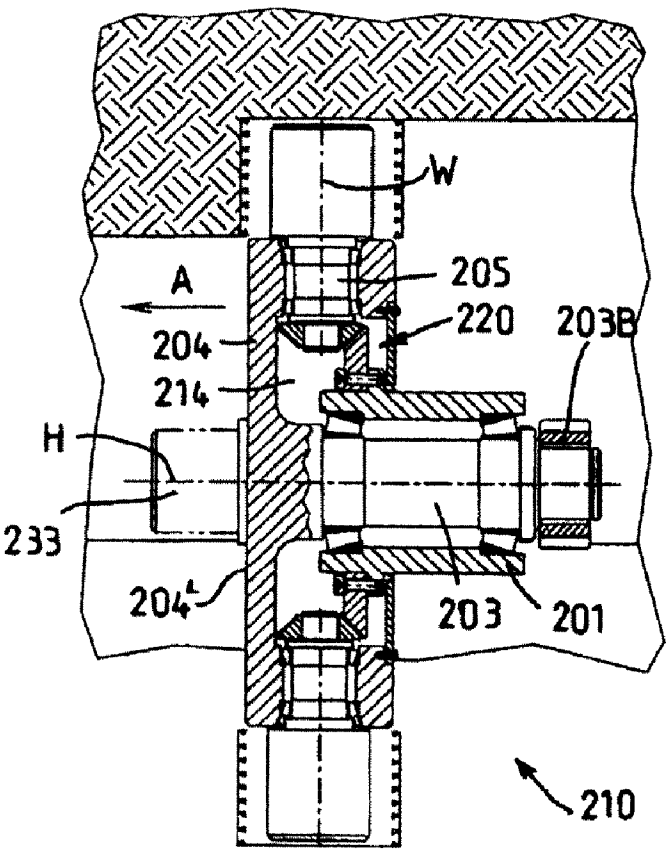

In the exemplary embodiments described above, the tool drum was in each case supported only on one side on a drum carrier. FIGS. 6A and 6B show a further exemplary embodiment of an apparatus 210 according to the invention, with a common rotary drive for the tool drum 204 and for the tool shafts 205 which here stand perpendicularly, but, if appropriate, also at an angle to the drum axis H. As in the previous exemplary embodiments, the rotation which is introduced to the drive shaft 203 via the gearwheel 203B can be transferred via the angular gear 220 into the tool shafts 205 with a corresponding step-up. The apparatus 210 illustrated in FIGS. 6A and 6B, a strong journal 233 projecting beyond the end face 204' is formed on the drum side lying opposite the gearwheel 203B and the gear receptacle 214 and lies centrically to the drum axis H, in order to support the apparatus 210 on both sides of the tool drum 204, on the one hand, via the journal 233 and, on the other hand, via the drum carrier 201. The working movement of the apparatus 210 is depicted in FIG. 6A by the arrow A parallel to the drum axis H, and FIG. 6B shows the direction of rotation R of the tool drum 204 for the apparatus 210 having, overall, six tool shafts 205 arranged, distributed uniformly over the circumference. It can be seen clearly from FIG. 6B, furthermore, how material is removed in the working direction, that is to say in to the drawing plane in FIG. 6B, by means of the apparatus 210.

Figure 7:
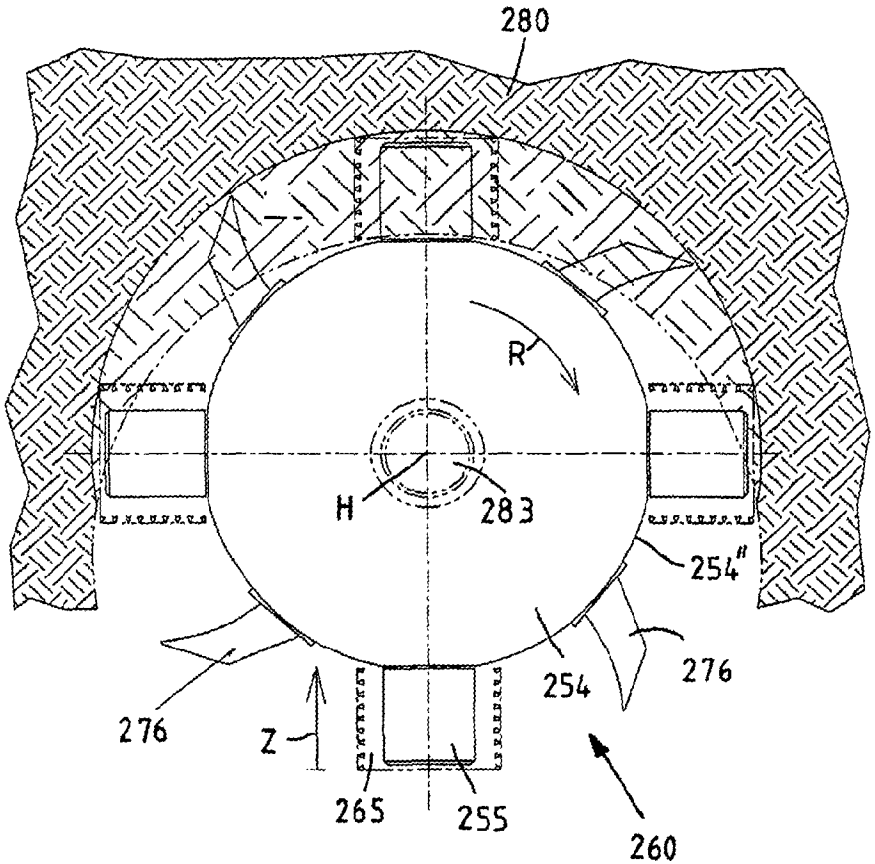
FIG. 7 shows a top view, similar to FIG. 6B, of a further example of the use of and apparatus according to the invention.

FIG. 7 shows a further apparatus 260 according to the invention with a tool drum 254 mounted on both sides, similarly to the exemplary embodiment in FIG. 6B. In contrast to the previous exemplary embodiment, however, here, not six, but only four tool shafts 255 with suitable tool carriers 265 designed, for example, as milling rollers are provided. Between the tool shafts 255 arranged in each case so as to be offset at an angle of 90° to one another is fastened in each case a shovel 276 which projects radially beyond the circumference 254" of the tool drum 254 and by means of which the material, such as, in particular, coal, released in the rock 280 at the working face by means of the rotating cutting tool from the tool carriers 265 can be loaded into a conveyor (not shown). The apparatus 260 travels, for example, along a conveyor and moves into the drawing plane in FIG. 7. The cutting tools on the tool carriers 265 release material by virtue of the overlapped rotational movement of the tool shafts 255 and of the tool drum 254 in the direction of rotation R, and the apparatus 260 conveys the released material by means of the scrapers or shovels 276 into a conveyor via a suitable ramp. As indicated by the arrow Z, the feed movement of the apparatus 260 takes place perpendicularly to the axis of rotation H of the tool drum 254, and, as in the previous exemplary embodiment, the tool drum 254 can also be held on both sides by means of the journal 283 indicated diagrammatically.

Figure 8:
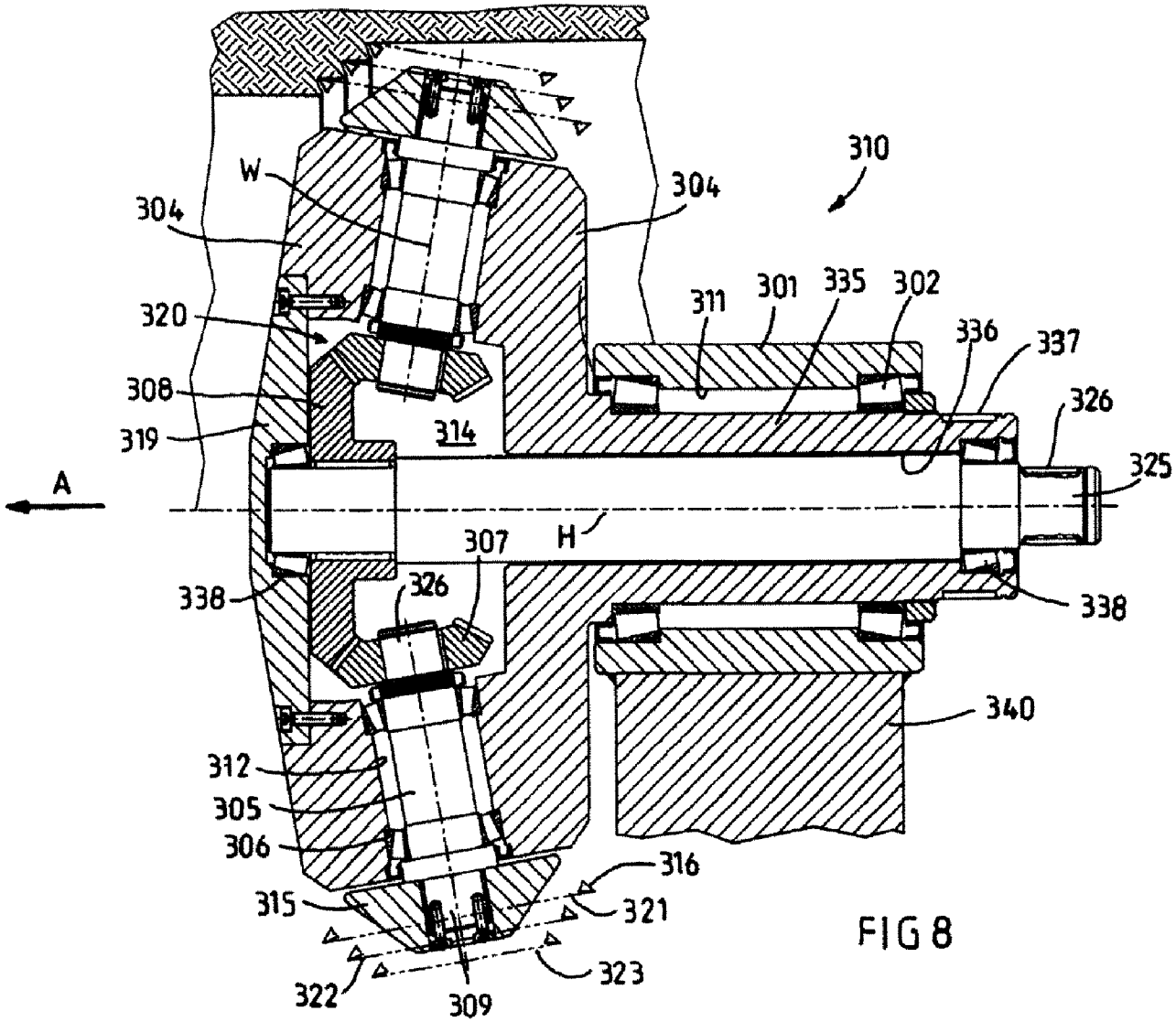
FIG. 8 shows in section an apparatus according to the invention in a sixth embodiment with decoupled rotary drives.

FIG. 8 shows an apparatus 310 in which the drive for the tool drum 304 is decoupled from the rotary drive for the tool shafts 305. The apparatus 310 may again be held via a drum carrier 301 which is fastened, for example, to a machine boom or carrying arm 340. In contrast to the previous exemplary embodiment, the tool drum 304 is provided with a hollow drum extension 335 which projects axially on one side and which is mounted rotatably by means of two tapered roller bearings 310 in the shaft receptacle 311 of the drum carrier 301 in such a way that the tool drum 304 is supported rotatably on the drum carrier 301 via the shaft extension or drum extension 335. A toothing 337 is formed on or a gearwheel is fastened to the free end, projecting out of the drum carrier 301, of the drum extension 325, via which toothing or gearwheel the shaft extension 335 and consequently also the tool drum 304 can be connected or coupled to a drum drive, not shown. The drum extension 335 forms, with its hollow shaft bore 336, a shaft receptacle for a gear drive shaft 325 mounted within the shaft bore 336 by means of a tapered roller bearing 338 arranged in an X arrangement. The gear drive shaft 325 is provided with a toothing 326 at its end projecting out of the shaft bore 336. The toothing 326 of the gear drive shaft 325 can be coupled to a gear drive, not illustrated, separate from the drum drive, so that the rotational speed ratio between the rotational speed of the tool drum 304 and the rotational speed of the tool shafts 305 can be set as desired. The relatively long gear drive shaft 325 is supported, with its second end projecting out of the reception bore 336 of the drum extension 335 and passing through the gear reception space 314, by means of a second tapered roller bearing 326 in a bearing cover 319 which is screwed to the tool drum 304 from that side of the latter which lies opposite the two drives. Consequently, in the apparatus 310, the gear receptacle 314 is open on the end face 304 pointing in the working direction A and is closed there by means of the bearing cover 319. The apparatus 310 has tool shafts 305, the tool shafts W of which run, angled at an angle of here about 80° to the drum axis H. The rotation which is introduced into the gear drive shaft 325 via the gearwheel 326 is transmitted by means of a driving gearwheel 308, connected fixedly in terms of rotation to the gear drive shaft 325 in the manner of a sun wheel, and in each case a power take-off gearwheel 307 connected fixedly in terms of rotation to each tool shaft 305, in the apparatus 310 according to FIG. 8 the entire angular gear 320 being arranged, well protected, in the gear receptacle 314. Once again, conical tool carriers 305 operating in an undercutting manner are fastened releasably to the free shaft ends 309 of the tool shaft 305 via the fastening screws illustrated. The apparatus 310 in FIG. 8 is provided with individual cutting tools 316 for three tool lines 321, 322, 323, in order to remove material at the working face in an undercutting manner and, as far as possible, with identical cutting powers. With the apparatus 310, an exchange of the tool shafts 305 can be carried out in that the bearing shell 319 is released and in each case the power take-off gearwheel 307 is drawn off after the removal of the driving gearwheel 308 lying adjacently to the bearing cover 319. The power take-off gearwheels 307 and the tool shafts 305 are then freely accessible via the gear receptacle 314, and, with the power take-off gearwheel 307 being drawn off and with a bearing ring 326 for the tapered roller bearing 306 being released, the tool shaft 305 can be drawn out of the radial passages 312 outwardly.

Figure 9:
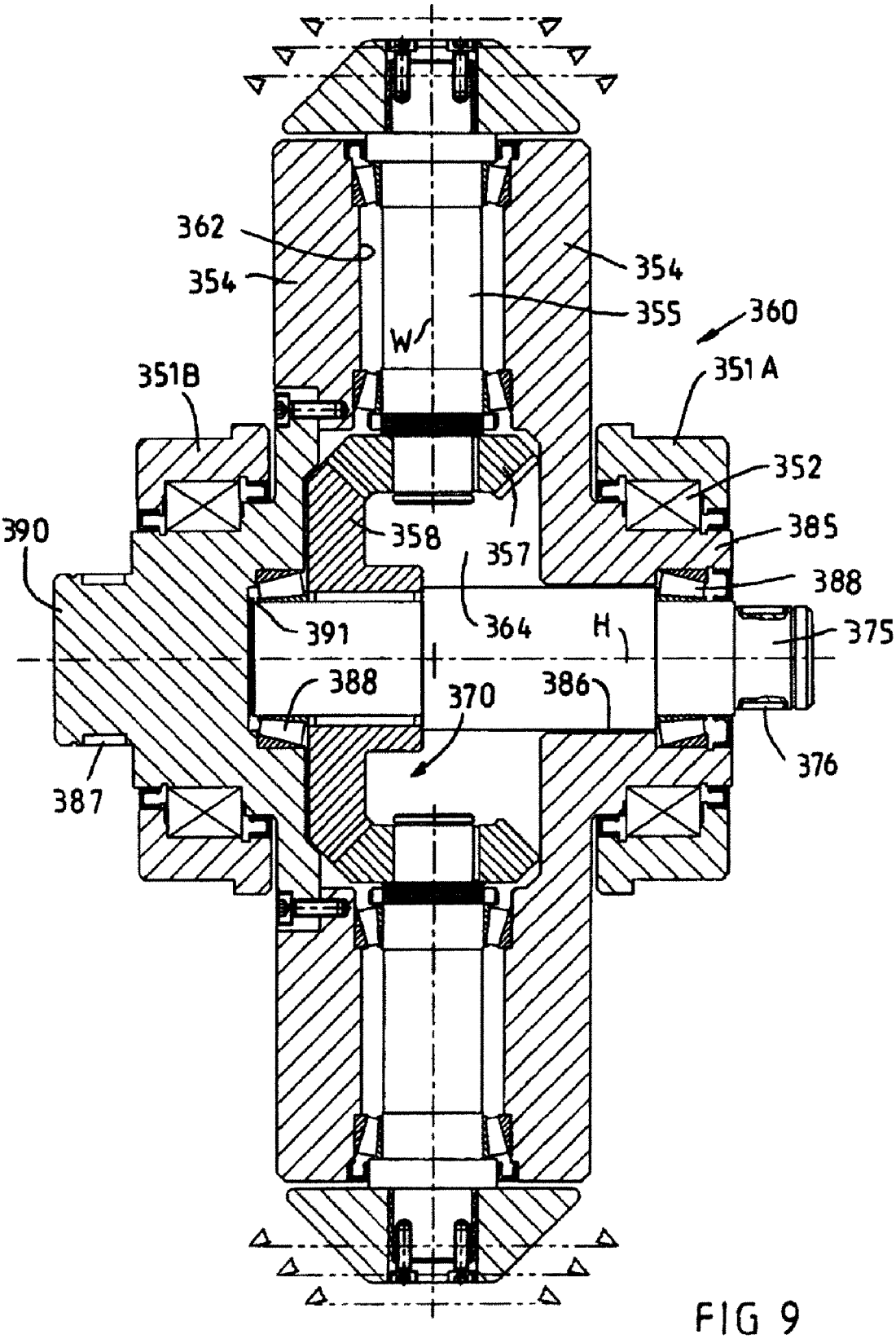
FIG. 9 shows in section an apparatus according to the invention in a seventh exemplary embodiment with decoupled rotary drives arranged on different sides of the tool drum.

In the exemplary embodiment of the apparatus 360 in FIG. 9, a drum drive for the tool drive 354 can be arranged on one side of the tool drum 354 and the gear drive for the angular gear 370 can be arranged, axially offset, on the other side of the tool drum 354. The tool drum 354, provided, distributed over the circumference, with a plurality of radial passages 362 for the reception of the tool shaft 355, has a relatively short annular extension 385 which is mounted via a first bearing 352 in a bearing shell 351A connectable to a drum carrier or forming part of a drum carrier. The annular or drum extension 385 once again forms, with its inner space, a shaft receptacle 386 for a gear drive shaft 375 which projects with one end out of the shaft receptacle 386 and which is provided at the correspondingly exposed end with a toothing 376 for coupling to a gear drive. A second rotary bearing 352 for supporting the apparatus 360 is located on the opposite side of the tool drum 354 and is held by means of a second bearing shell 351B which again can be connected to a tool carrier or to the arm of a boom or the like. On the side lying opposite the annular extension 385, here a multiply stepped bearing extension 390 is screwed to the tool drum 354 and is provided at its free end with a toothing 387 to which a drum drive can be coupled. The bearing extension 390 is supported via one of its steps and the further bearing 352 on the second bearing shell 351B. The inside of the bearing extension 390, here forming a screwed-on bearing flange, is provided with a recess 391 in which the second, free end of the gear drive shaft 375 is supported by means of a second tapered roller bearing 388. The transmission of the rotation of the gear drive shaft 375 to the tool shafts 355, the shaft axes W of which here stand perpendicularly to the drum axis H, once again takes place via an angular gear 370 having a driving gearwheel 358 which is arranged fixedly in terms of rotation on the gear drive shaft 375 and with which in each case a power take-off gearwheel 357 rotating as a planet wheel with the tool drum 354 and driving the tool shaft 355 meshes. As a result of the decoupling of the drive for the tool drum 354 and of the drive for the tool shafts 355, the path curve of the individual tool cutters can be determined, and the grain size of the released material can thus be set reliably to the desired size. If the material properties change, the rotational speed ratio can be adjusted continuously, without an interruption in the cutting work, and can be adapted to the respective requirements.

Figure 10:
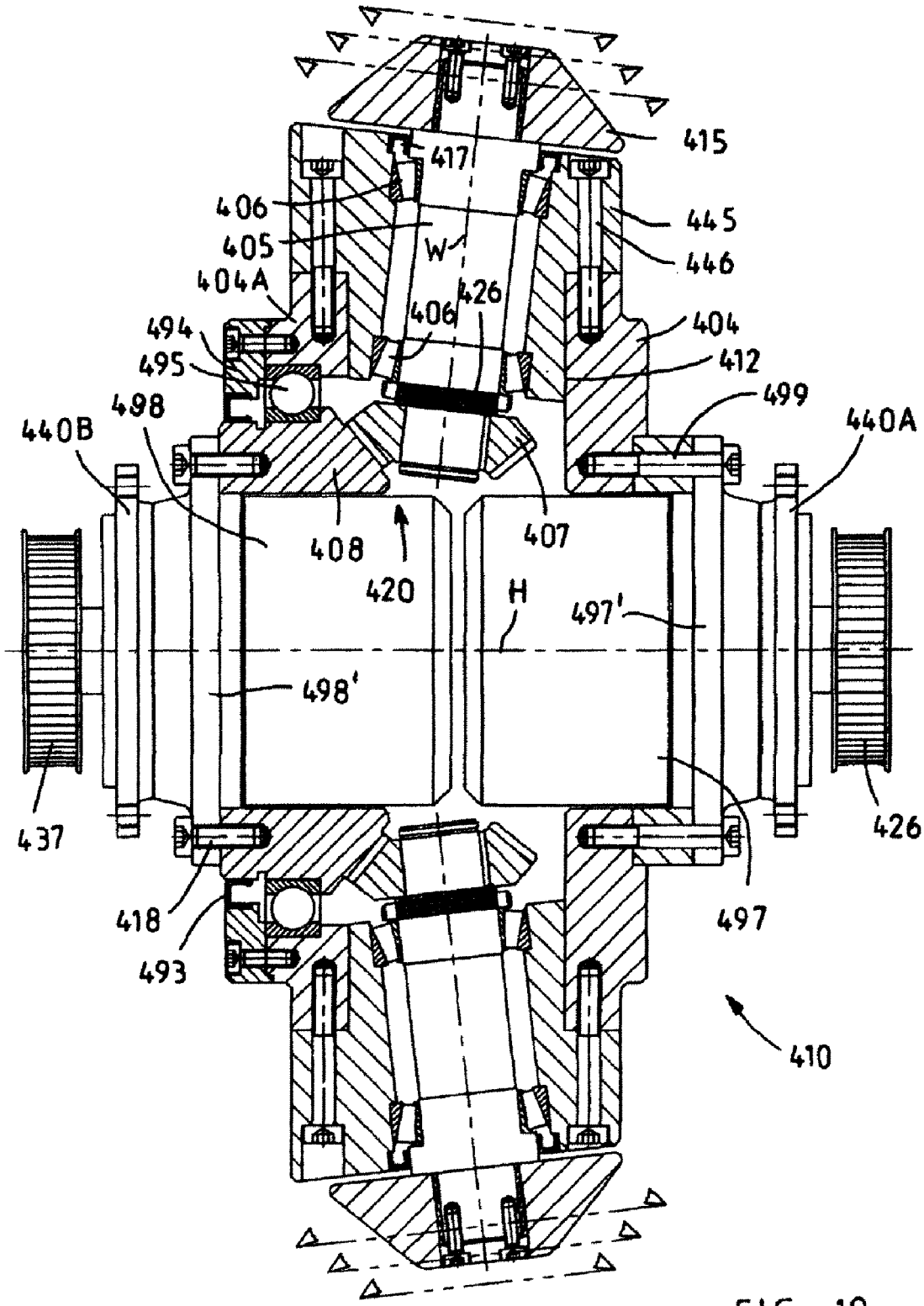
FIG. 10 shows in section an apparatus according to the invention in an eighth exemplary embodiment with centrally arranged hub gears.

The apparatus 410 shown in FIG. 10 again has, to implement the cutting movement according to the invention, a plurality of tool shafts 405 which are arranged, distributed over the circumference of a tool drum 404, and the shaft axes W of which here stand, angled to the drum axis H of the tool drum 404. The individual tool shafts 405, which are fitted with conical tool carriers 415 operating in an undercutting manner, are arranged in each case in bearing bushes 445 which are screwed on the end face to the circumference of the tool drum 404 by means of a plurality of fastening screws 446. Each bearing bush 445 is exchangeable in a cartridge-like manner and is inserted into a drum chamber 412 via the screw connection 446 from the circumferential side. The apparatus 410 can usually be converted without problems to a configuration with tool shafts standing perpendicularly to the drum axis H, in that bearing bushes are used in which the tool shafts are arranged perpendicularly. Within each bearing bush 445, the tool shafts 405 are received, in turn, by means of two tapered roller bearings 406, a bearing ring 426 and a shaft sealing ring 417, and a power take-off gearwheel 407, as a bevel gearwheel of an angular gear 420, is arranged on the free inner shaft end of each tool shaft 405. In the apparatus 410, the drive of the tool drum 404 takes place by means of a toothed belt via a belt pulley 426 on the right side of the apparatus 410, while the drive of the tool shafts 405 takes place via a belt pulley 437 on the left side of the apparatus 410. The belt pulley 426 for the drum drive is connected to the drive side of a first hub gear 497, encapsulated by a housing and illustrated merely by its housing, and the belt pulley 437 is connected to the drive side of a second hub gear 498. The hub gear 497 for driving the tool drum 404 is mounted on a first fastening flange 340A and the hub gear 498 for the driving gearwheel 408 is mounted on a second fastening flange 440B, via which fastening flanges the entire apparatus 410 can be fastened to a drum carrier, not illustrated, such as, for example, a fork-shaped boom arm. The power take-off side 498' of the second hub gear 498 is screwed to the driving gearwheel 408 via the screw 418, and the power take-off side 497' of the first hub gear 497 is screwed to the tool drum 404 via the screw 499. Between the drum ring 404A, on the left in FIG. 10, of the tool drum 404 and the driving gearwheel 408, a ball bearing 495 is arranged, which is held in position, protected against soiling, by means of a bearing ring 494 and a shaft seal 493. The driving gearwheel 408 common to all the power take-off gearwheels 407 and driven via the hub gear 498 can therefore rotate at any desired rotational speed in relation to the likewise driven tool drum 404, with the result that the rotational speed ratio between the tool drum 404 and tool shafts 405 can be set virtually as desired. The apparatus 410 has an extremely compact build, since both hub gears 497, 498 are designed as push-in gears, lie concentrically to the drum axis H and fill essentially the inner space within the tool drum 404.

Figure 11:
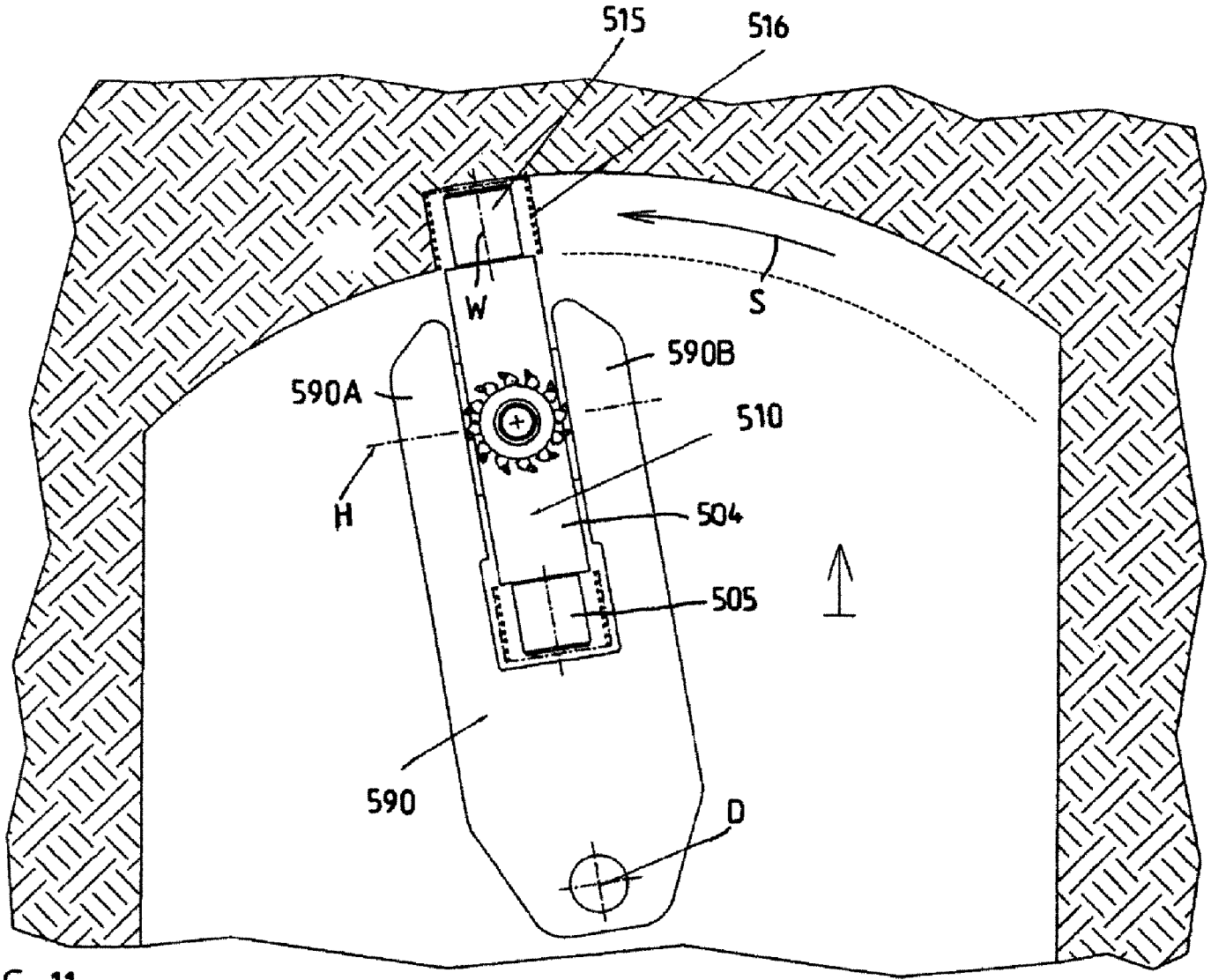
FIG. 11 shows the use of an apparatus according to the invention on a pivotable boom.

The apparatus according to the invention can be moved rectilinearly in the working direction and then be moved back in the opposite direction after a feed movement in the feed direction has taken place. FIG. 11 shows an exemplary embodiment of an oscillating use of an apparatus 510 according to the invention, here with four tool shafts 505 arranged, distributed over the circumference of a tool drum 504. The tool drum 504 is held on both sides on two boom arms 590A, 590B of a boom 590 which can be pivoted about the center of rotation D. During pivoting, the cutting tools 516 on the tool carriers 515 remove the material 530 in the pivoting direction S. In this case, both the tool carriers 515 rotate about the shaft axes W and the tool drum 504 rotates about the drum axis H. It is possible only ever to remove material in one direction; alternatively, removal may also take place in both pivoting directions, so that, after a pivot has been completed, a renewed feed takes place approximately by the amount of one tool width, in order subsequently to remove material at the working face 530 in the other pivoting direction. It will be possible, further, to configure the boom 590 so as to be vertically movable in order to extract material from an even larger cross section.

The preceding description suggests to a person skilled in the art numerous modifications which will come within the scope of protection of the appended claims. It will be appreciated that, in virtually all the exemplary embodiments, instead of tool shafts standing perpendicularly, tool shafts standing at an angle could also be used, and vice-versa. Instead of an angular gear, in each case a contrate gear could also be used, which would have the advantage that, when rock is being broken down, no forces would be introduced parallel to the axis of the tool shafts into the drive shaft. In the gear receptacle, in each case an angular gear with a plurality of output shafts could also be placed, or the tool shafts could be driven via cardan shafts or the like. The apparatus may be employed in the most diverse possible fields and, depending on the intended use, with virtually all known tools. The preferred fields of use are, in particular, mining for the extraction of ores or coal, roadbuilding for removal of coverings, open cast mining, tunnel building for the driving of tunnels, pit construction, civil engineering in the drawing of, for example, trenches, or building construction for the renovation of floors and walls.

Further, while considerable emphasis has been placed on the preferred embodiments of the invention illustrated and described herein, it will be appreciated that other embodiments, and equivalences thereof, can be made and that many changes can be made in the preferred embodiments without departing from the principles of the invention. Furthermore, the embodiments described above can be combined to form yet other embodiments of the invention of this application. Accordingly, it is to be distinctly understood that the foregoing descriptive matter is to be interpreted merely as illustrative of the invention and not as a limitation.

The invention claimed is:

1. An apparatus for the milling and/or drilling cutting of materials, in particular for the removal of rock, minerals or coal, the apparatus comprising a tool drum which is mounted on a drum carrier and which is rotatable about a drum axis, a plurality of tool shafts having ends and which carry cutting tools at their ends, the tool shafts projecting from the tool drum and are each rotatable and drivable mounted about a shaft axis, at least two of the tool shafts being drivable by a common gear drive and the gear drive including a power take-off gearwheel arranged fixedly in terms of rotation on the tool shafts and a common drive element which cooperates with the power take-off gearwheels, the drive element and the tool drum being rotatable in relation to one another, the shaft axes of the tool shafts stand transversely to the drum axis.

2. The apparatus as claimed in claim 1 wherein the shaft axes of the tool shafts stand perpendicularly to the drum axis.

3. The apparatus as claimed in claim 1, wherein the shaft axes of the tool shafts stand angled to the drum axis, the angle of the angling preferably being greater than about 80°.

4. The apparatus as claimed in claim 1, wherein in operational use, a working movement takes place parallel to the drum axis.

5. The apparatus as claimed in claim 1, wherein all the cutting tools are located radially outside the tool drum and, in operational use, remove material in a sickle-shaped matter.

6. The apparatus as claimed in claim 1, wherein in operational use, by virtue of the rotational movement of the tool drum, the cutting tools rotate transversely to the drum axis and remove the material outside a circumference of the tool drum.

7. The apparatus as claimed in claim 1, wherein the tool drum and at least some of the tool shafts have a common rotary drive.

8. The apparatus as claimed in claim 7, wherein the rotary drive has a drive shaft which is connected fixedly in terms of rotation to the tool drum and is mounted in the drum carrier and can be driven by means of a drive device, the drive element including at least one driving gearwheel which is fastened fixedly in terms of rotation to the drum carrier and which meshes with the power take-off gearwheels.

9. The apparatus as claimed in claim 8, wherein the driving gearwheel and the associated power take-off gearwheels form an angular gear including toothed bevel wheels and planet wheels.

10. The apparatus as claimed in claim 8, wherein the driving gearwheel and the associated power take-off gearwheels form a contrate gear including a toothed contrate wheel and cylindrical gearwheels and having planet wheels.

11. The apparatus as claimed in claim 7, wherein the tool drum is supported on both sides of the tool shafts on a tool carrier, the apparatus further including a journal or bearing for holding the tool drum on two sides being formed preferably on the side of the tool drum which lies opposite the drive device.

12. The apparatus as claimed in claim 1, wherein the tool drum has a drum drive which is decoupled from the gear drive and the drive element.

13. The apparatus as claimed in claim 12, wherein at least one of the drum drive and the gear drive is a variable drive.

14. The apparatus as claimed in claim 12, wherein the drum drive and the gear drive are coupled on the same side of the tool drum.

15. The apparatus as claimed in claim 12, wherein the tool drum further includes an axially projecting shaft receptacle in which a gear drive shaft extends therethrough and is connected fixedly in terms of rotation to the driving gearwheel and projecting on both sides out of a reception bore and the shaft receptacle is supported rotatably.

16. The apparatus as claimed in claim 15, wherein the gear drive shaft is supported by means of a first bearing in the reception bore and a second bearing in a bearing cover fixed to the tool drum.

17. The apparatus as claimed in claim 15, wherein the shaft axes stand angled to the drum axis and the driving gearwheel and the power take-off gearwheels are designed as bevel wheels of an angular gear having planet wheels.

18. The apparatus as claimed in claim 15, wherein the shaft receptacle is coupled to the drum drive and the gear drive shaft is coupled to the gear drive.

19. The apparatus as claimed in claim 12, wherein the apparatus has a first side and an oppositely facing second side which are axially spaced from one another along the drum axis, the drum drive being coupled on first side and the gear drive being coupled on the second side and offset axially on the opposite side of the tool drum.

20. The apparatus as claimed in claim 19, wherein the tool drum is provided on the opposite side with an axially projecting annular extension with a shaft receptacle, in which a gear drive shaft connected fixedly in terms of rotation to the driving gearwheel and projecting on both sides out of a reception bore of the shaft receptacle is supported rotatably, and has on the other side a bearing extension on which the drum drive can be arranged or can be coupled.

21. The apparatus as claimed in claim 20, wherein the gear drive shaft is mounted rotatably by a first bearing in the shaft receptacle of the annular extension and a second bearing in the bearing extension.

22. The apparatus as claimed in claim 19, wherein the tool drum is connected fixedly in terms of rotation to a power take-off side of a first hub gear and the driving gearwheel is connected fixedly in terms of rotation to a power take-off side of a second hub gear, the two hub gears being arranged in a central receptacle.

23. The apparatus as claimed in claim 22, wherein the hub gears are designed as push-in gears with preferably encapsulated gear stages, the fastening flanges of the two hub gears being fastenable to the drum carrier.

24. The apparatus as claimed in claim 15, wherein the driving gearwheel and the power take-off gearwheels include at least one of a bevel wheel of an angular gear with planet wheel, a contrate wheel, a cylindrical gearwheels and planet wheels.

25. The apparatus as claimed in claim 1, wherein the power take-off gearwheels of all the tool shafts are in toothed engagement with a single common driving gearwheel.

26. The apparatus as claimed in claim 1, wherein each of the cutting tools arranged on the tool shaft is arranged, offset by an angular amount or at a distance from the drive shaft, in relation to the arrangement of a cutting tool of an adjacent tool shaft in the drum circumferential direction.

27. The apparatus as claimed in claim 1, wherein the cutting tools includes at least one of a roller chisel and a straight shank chisels which are arranged on at least one of outwardly tapering tool carriers and ends of the tool shaft, at least one tool carriers and ends of the tool shafts include a taper that is at least one of a conical taper, an arcuate taper and a stepped taper, the cutting tools on each tool shaft are arranged in cutting rows on pitch circles with different diameters, the distance between two cutting rows preferably being selected in such a way that all the cutting rows remove sickle-shaped cutting surfaces of approximately identical size.

28. The apparatus as claimed in claim 1, wherein the cutting tools of the tool shafts succeeding one another in the circumferential direction of the tool drum are arranged so as to be phase-offset with respect to one another.

29. The apparatus as claimed in claim 1, wherein the tool shafts are supported rotatably at their radially outer end by means of a yoke with a journal which is fastened to the tool drum.

30. The apparatus as claimed in claim 1, wherein the tool drum is provided between adjacent tool shafts with radially extending scrapers or shovels.

31. A method for the milling or removal of rock or the like, using an apparatus comprising a tool drum which is mounted on a drum carrier and which is rotatable about a drum axis, a plurality of tool shafts having ends and which carry cutting tools at their ends, the tool shafts projecting from the tool drum and are each rotatable and drivable mounted about a shaft axis, at least two of the tool shafts being drivable by a common gear drive and the gear drive including a power take-off gearwheel arranged fixedly in terms of rotation on the tool shafts and a common drive element which cooperates with the power take-off gearwheels, the drive element and the tool drum being rotatable in relation to one another, the shaft axes of the tool shafts stand transversely to the drum axis, the method includes the steps of setting the rotational speed of the tool shafts, the rotational speed of the tool drum, the advancing speed of the apparatus parallel to the drum axis and/or the angular position of the cutting tools, arranged on the individual tool shafts, in relation to the angular position of the cutting tools of the tool shafts lying in front of or behind them in the circumferential direction such that a cutting tool of a following tool shaft does not strike at an associated rock or the like structure at the same striking point as a cutting tool of a preceding tool shaft.

32. The method as claimed in claim 26, further including the step of maintaining only a few cutting tools in engagement with the associated rock or the like structure at one time.

* * * * *